US011380227B2

(12) United States Patent
Thierbach et al.

(10) Patent No.: US 11,380,227 B2
(45) Date of Patent: Jul. 5, 2022

(54) TRUSS SYSTEM FOR VIDEO DISPLAYS

(71) Applicant: CHRISTIE DIGITAL SYSTEMS USA, INC., Cypress, CA (US)

(72) Inventors: Brett Alan Thierbach, Clarkston, MI (US); Charles Thomas Laszyca, West Bloomfield, MI (US)

(73) Assignee: CHRISTIE DIGITAL SYSTEMS USA, INC., Cypress, CA (US)

( * ) Notice: Subject to any disclaimer, the term of this patent is extended or adjusted under 35 U.S.C. 154(b) by 80 days.

(21) Appl. No.: 16/916,992

(22) Filed: Jun. 30, 2020

(65) Prior Publication Data

US 2021/0407347 A1 Dec. 30, 2021

(51) Int. Cl.
*G09F 15/00* (2006.01)
*G09F 9/302* (2006.01)

(52) U.S. Cl.
CPC ..... *G09F 15/0012* (2013.01); *G09F 9/3026* (2013.01)

(58) Field of Classification Search
None
See application file for complete search history.

(56) References Cited

U.S. PATENT DOCUMENTS

| | | | | |
|---|---|---|---|---|
| 2,507,857 | A * | 5/1950 | Johnson | A63J 1/02 40/624 |
| 5,900,850 | A * | 5/1999 | Bailey | G09F 9/3026 345/55 |
| 8,104,207 | B2 * | 1/2012 | Pitcher | G09F 7/20 40/617 |
| 8,418,425 | B1 * | 4/2013 | Santini | E04H 3/28 52/655.1 |
| 8,418,980 | B2 * | 4/2013 | Wakura | G09F 7/20 248/328 |
| 9,803,365 | B2 * | 10/2017 | Peltier | E04C 3/083 |
| 9,978,295 | B1 * | 5/2018 | Denby | G09F 15/0056 |
| 9,995,430 | B2 | 6/2018 | Miller | |
| 2013/0232835 | A1 * | 9/2013 | Davis | G09F 9/33 40/606.14 |
| 2014/0239139 | A1 * | 8/2014 | Opsomer | G09F 15/0068 248/329 |
| 2018/0080602 | A1 * | 3/2018 | Miller | A63J 1/02 |

* cited by examiner

*Primary Examiner* — David R Dunn
*Assistant Examiner* — Christopher E Veraa
(74) *Attorney, Agent, or Firm* — Perry + Currier, Inc.

(57) ABSTRACT

A truss system configured as a rectangular frame and a rigging plate is provided. The rectangular frame comprises an interconnected assembly of rectangular tubes. The rigging plate is removably attached to a top surface of the rectangular frame and includes an overhanging portion that overhangs a front side of the rectangular frame. The overhanging portion includes a plurality of attachment apparatuses for suspending at least one video display from the overhanging portion such that the video display(s) overhangs the front side of the rectangular frame.

13 Claims, 4 Drawing Sheets

TRUSS SYSTEM FOR VIDEO DISPLAYS

FIELD

This application relates generally to a truss system for video displays.

BACKGROUND

Video walls and LED (Light Emitting Diode) screens are often suspended from portable truss systems or scaffolds. Because of the enormous weight of video displays, stability is a particular challenge.

One solution is to anchor the truss system with ballast, however, there are a number of drawbacks to this solution. The ballast is typically positioned on the ground, which creates a tripping hazard and extends the footprint of the truss system considerably. The cables tethering the truss system to the ballast raise further hazards and interfere with the technician's ability to access the system for maintenance, assembly, and disassembly. Consequently, technicians have been known to release the ballast during their work, contrary to safety guidelines.

SUMMARY

It is an aspect of the present application to provide a truss system for suspending video displays in front of the truss using conventional and inexpensive components.

The above aspects may be attained by a truss system having a rectangular frame and a rigging plate. The rectangular frame is built from a number of rectangular tubes that together form an interconnected assembly. The rigging plate is attached to the top of the rectangular frame. Part of the rigging plate extends past the rectangular frame, creating an overhang on the front side. This overhanging part of rigging plate includes a number of attachment apparatuses for suspending the video display(s).

In another aspect of the application, the rectangular frame may have two or more support feet. The support feet may be designed to support the combined center of gravity of the truss system and the video display(s).

In a further aspect of the application, the attachment apparatuses may have apertures for attaching the video display(s) to the rigging plate with fasteners.

In a yet further aspect, the attachment apparatus may be a slidable attachment mechanism having a connector that slides along a track. The video display(s) may be suspended from the connector.

In another aspect of the application, the rectangular tubes may be hollow, having cavities within. In order to access the cavities, the rectangular tubes may have openings.

In a further aspect of the application, the rigging plate may have openings that align with the openings in the rectangular tubes. The cavity of the rectangular tubes may be accessible through the openings in the rigging plate.

It is an aspect of the application to provide two or more of the rectangular frames described above that are positioned side-by-side in a truss system. The rectangular frames are built from a number of rectangular tubes that together form interconnected assemblies. Rigging plates are attached to the top of the rectangular frames. Part of each rigging plate extends past the rectangular frame, creating an overhang on the front side. These overhanging parts include a number of attachment apparatuses for suspending two or more video displays. The suspended video displays form a continuous viewing surface.

Neighboring rectangular frames may be removably attached to one another.

In another aspect, the rectangular frames may have two or more support feet. The support feet may be designed to support the combined center of gravity of the truss systems and the video displays.

In a further aspect, the attachment apparatuses may have apertures for attaching the video displays to the rigging plates with fasteners.

In a yet further aspect, the attachment apparatuses may be slidable attachment mechanisms having connectors that slide along tracks. The video displays may be suspended from the connectors.

In another aspect, the rectangular tubes may be hollow, having cavities within. In order to access the cavities, the rectangular tubes may have openings.

In a further aspect, the rigging plates may have openings that align with the openings in the rectangular tubes. The cavity of the rectangular tubes may be accessible through the openings in the rigging plates.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

For a better understanding of the various examples described herein and to show more clearly how they may be carried into effect, reference will now be made, by way of example only, to the accompanying drawings in which.

DETAILED DESCRIPTION

An aspect of the present specification provides a truss system for suspending video displays in front of the truss using conventional and inexpensive components. The above aspects may be attained by a truss system having a rectangular frame and a rigging plate. The rectangular frame may be built from a number of rectangular tubes that together form an interconnected assembly. The rigging plate may be attached to the top of the rectangular frame. Part of the rigging plate may extend past the rectangular frame, creating an overhang on the front side. This overhanging part may include a number of attachment apparatuses for suspending the video display(s).

Figure 1:
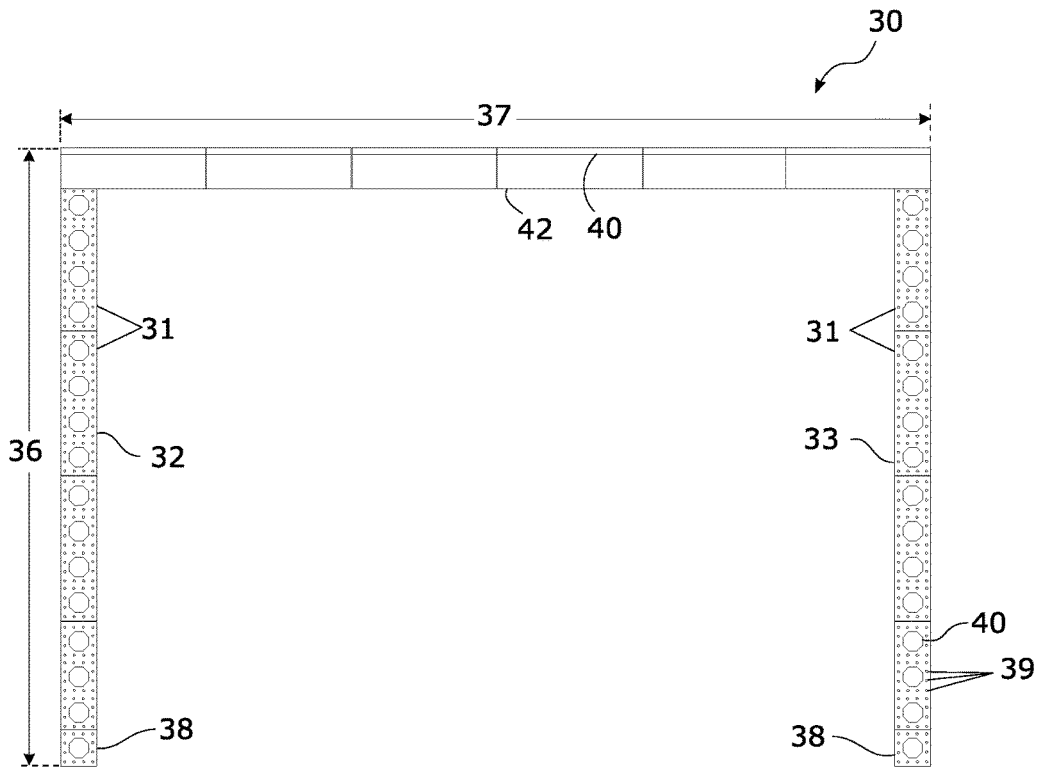
FIG. 1 shows a front view of a truss system.
Figure 2:
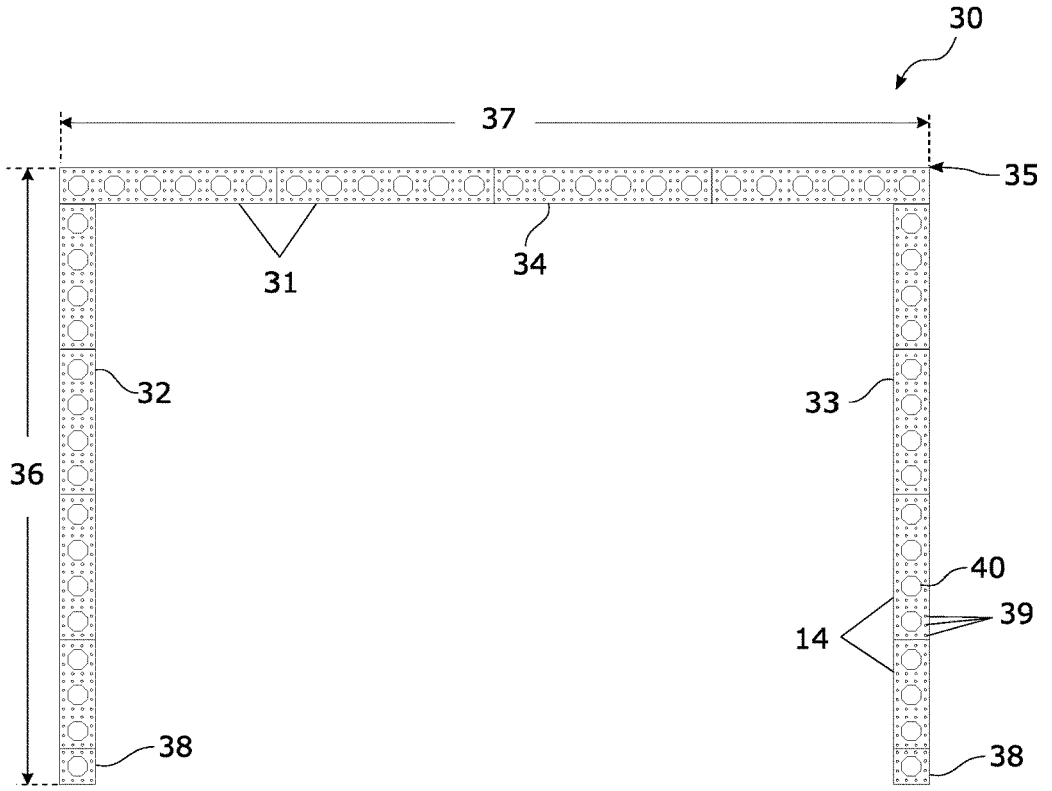
FIG. 2 shows a front view of a truss system.
Figure 3:
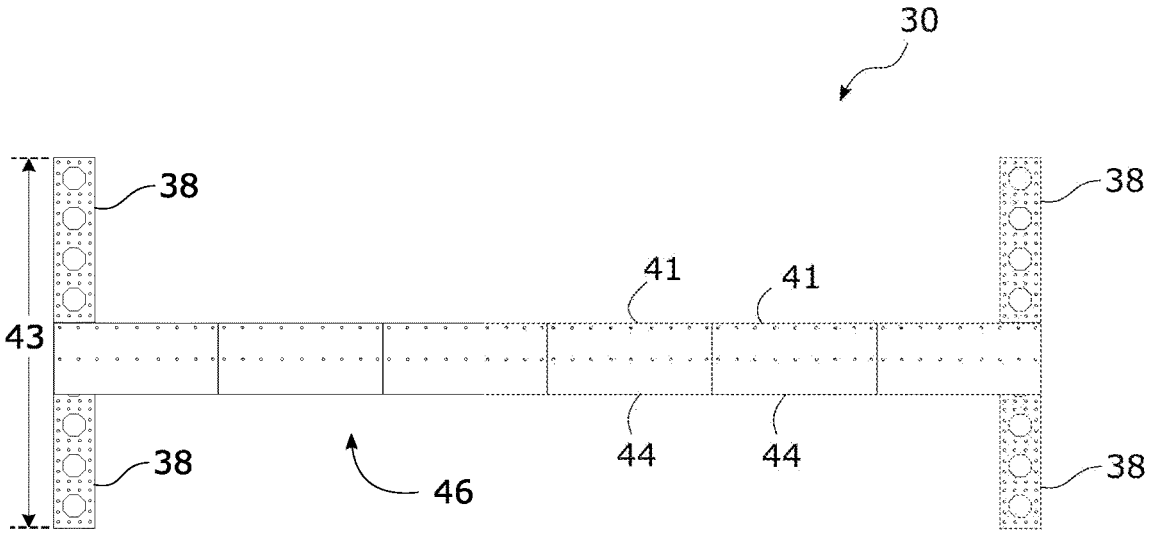
FIG. 3 shows a top view of the truss system.

Referring to FIGS. 1, and 2, and 3, a truss system 30 is generally shown. The truss system 30 comprises a plurality of interconnected rectangular tubes 31 forming a rectangular frame. In this configuration, the rectangular frame has three sides: two vertical sides 32, 33 that are connected by a horizontal beam 34. The horizontal beam 34 may have a top surface 35. Optionally, the rectangular frame 30 may have additional cross beams or diagonal support features (not shown). In FIGS. 1 and 2, the truss system has a height 36 of about 4250 mm and a width 37 of about 6000 mm, however any suitable range of dimensions are within the scope of the present specification. Indeed, any suitable dimensions compatible with suspending video displays from the rectangular frame 30, as described herein, is within the scope of the present specification. The truss system 30 may additionally have two or more support feet 38. In FIG. 1, the rectangular frame 30 is depicted with two support feet 38 connected to one of the vertical sides 32, 33. The support feet 38 may comprise interconnected rectangular tubes 31.

In some examples, the rectangular tubes 31, from which various components of the rectangular frame 30 are constructed, to be identical or similar. In the configuration shown in FIG. 2, the horizontal beam 34 comprises four rectangular tubes 31 each having a length of about 1500 mm, while the vertical sides 32, 33 respectively comprise four rectangular tubes 31 having a length of about 1000 mm. However, the rectangular tubes 31 are not limited to those lengths and any suitable lengths are within the scope of the present specification. In some examples, the rectangular frame 30 may comprise one size of rectangular tube. One benefit of building the rectangular frame 30 and support feet 38 with one, or a few, sizes of rectangular tubes is that the rectangular tubes 31 may be interchangeable. This feature may greatly simplify the assembly process and may increase the efficiency of replacing components in the rectangular frame 30. A rectangular tube 31 may be attachable to another rectangular tube 31 with fasteners received by fastener holes 39. The rectangular tubes 31 may have a plurality of fastener holes 39. This configuration may facilitate one rectangular tube to be attached to another rectangular tube at a number of different attachment sites. The configuration may enable multiple rectangular tubes to attach to other rectangular tubes. The attachment between adjoining rectangular tubes may be strengthened with reinforcing plates (not shown).

The rectangular tubes 31 may include, and/or be fabricated from, one or more materials including, but not limited to, steel, aluminum, metal alloys, carbon fiber, fiber reinforced plastic, and the like.

The rectangular tubes 31 may further comprise openings 40 for accessing a cavity of the rectangular frame (not shown). The openings 40 may allow a hand or device to be inserted to tighten or loosen fasteners from the inside of the rectangular tube 31. Further, the cavity may act as a cable tray for the video displays and the openings may enable access to the cable tray and/or the cables. The openings 40 may have a number of sizes and shapes and should not be limited to that shown in the figures. In some examples, the fastener holes 39 may be positioned concentrically around the openings 40, such that an opening in one rectangular tube aligns with an opening of another rectangular tube when the two rectangular tubes are attached with fasteners.

As shown in FIG. 1, the truss system 30 may additionally include one or more rigging plates 41 attached to a top surface (35 in FIG. 2). The rigging plate 41 may include one or more screens 42 for concealing connectors or attachment mechanisms. The rigging plate 41 may comprise a number of materials including, but not limited to, steel, aluminum, metal alloys, carbon fiber, or fiber reinforced plastic.

Referring now to FIG. 3, a top view of the truss system 30 is shown. The truss system 30 may include two or more support feet 38. In the figure shown, the truss system 30 has two pairs of support feet 38. The length 43 of a pair of support feet is about 2240 mm in this particular iteration, however a number of lengths are contemplated. The dimensions of the support feet are generally selected according to the weight and dimensions of the truss system 30 as well as the weight of the suspended video displays. If ballast is used in the system, that may also affect the dimensions of the support feet.

One or more rigging plates 41 may be attached to a top surface (shown previously in FIG. 2) of the truss system 30. In some configurations, the rigging plates 41 are removably attached to the top surface using any suitable fasteners, including, but not limited to, bolts, screws and the like. An overhanging portion (described in more detail below) of the rigging plates 44 may extend past the top surface on a front side 46 of the truss system 30.

Figure 4:
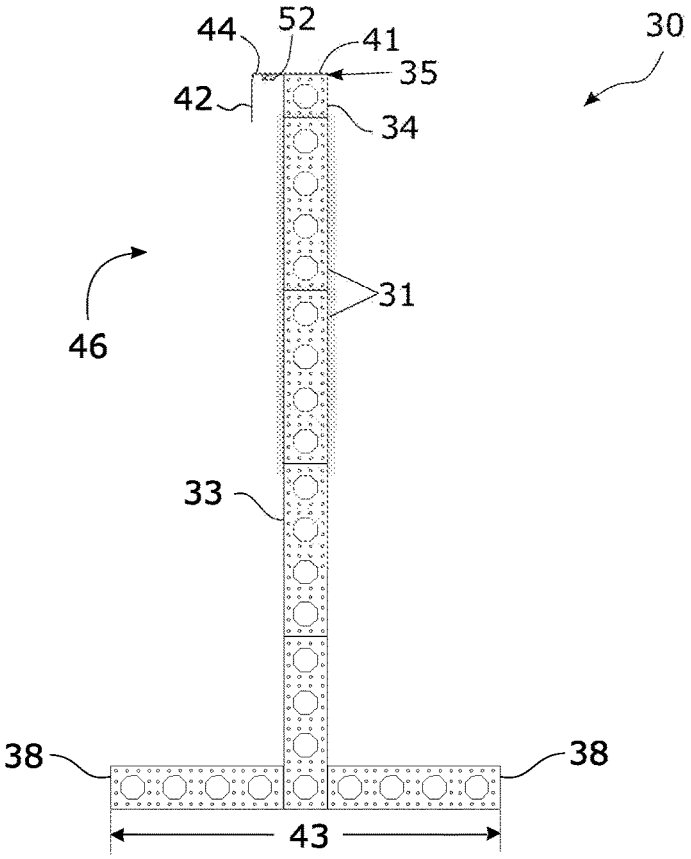
FIG. 4 shows a side view of the truss system.

In FIG. 4, a side view of the truss system 30 is shown. The truss system 30 is depicted with a horizontal beam 34 having a top surface 35, a vertical side 33, a second vertical side (not shown), and two support feet 38. The truss system 30 comprises a plurality of rectangular tubes 31. Additionally, a rigging plate 41 is removably attached to the top surface 35 of the truss system 30. An overhanging portion 44 of the rigging plate 41 may extend past the top surface 35 of the truss system 30. The overhanging portion may include one or more attachment apparatuses 52 for suspending a video display in front of the truss system 30. In the configuration shown in FIG. 4, the attachment apparatus 52 comprises a slidable attachment mechanism, however many different types of attachment apparatuses may be used, slidable or otherwise. For example, the attachment apparatuses 52 may comprise holes for accommodating bolts, screws, fasteners, hooks, carabiners, or other connectors. In some examples, as depicted, the truss system 30 includes a screen 42 to conceal the attachment apparatuses 52 when viewed from the front side 46 of the truss system 30. The screen 42 may further protect the attachment apparatuses 52 from debris.

Figure 5:
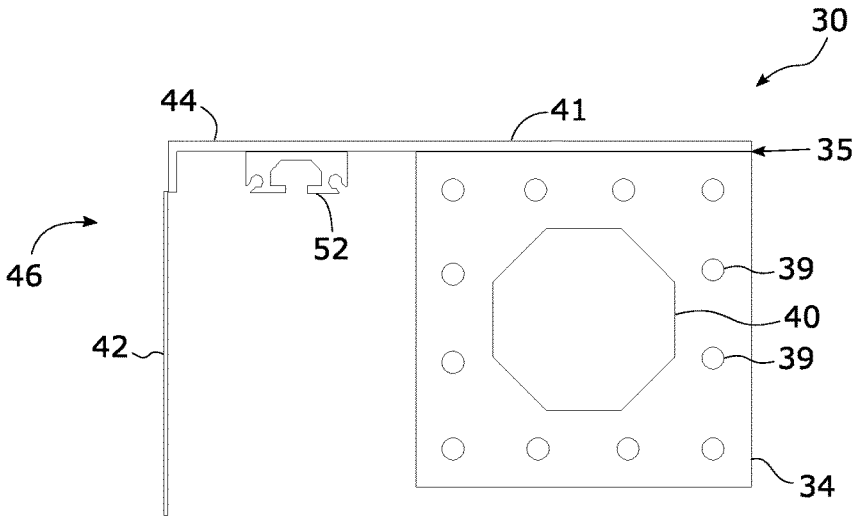
FIG. 5 shows a partial side view of the truss system.

FIG. 5 depicts a partial side view of a portion of the truss system 30 that includes the rigging plate 41. This view shows the horizontal beam 34 having an opening 40 and a plurality of fastener holes 39. The rigging plate 41 may be removably attached to the top surface 35 of the horizontal beam 48. An overhanging portion of the rigging plate 44 may extend past the horizontal beam 34 on the front side 46 of the truss system 30.

The overhanging portion of the rigging plate 44 may include at least one attachment apparatus 52 for suspending video displays. The attachment apparatuses 52 shown are slidable attachment mechanisms, however, as explained above, any suitable number of attachment apparatuses are within the scope of the present specification. The slidable attachment mechanism may be configured to accommodate one or more connectors (shown later in FIG. 8) which may slide along the length of the slidable attachment mechanism. The connectors may be attachable to one or more video displays such that the video display(s) may be suspended from the attachment mechanism. In some configurations, one video display may be suspended from one connector. In other configurations, a video display may be suspended from two or more connectors. In yet further configurations, one connector is attached to a plurality of video displays. The rigging plate may further include a screen 42 to conceal the connectors (shown later in FIG. 8) when the truss system 30 is viewed from the front side 46.

Figure 6:
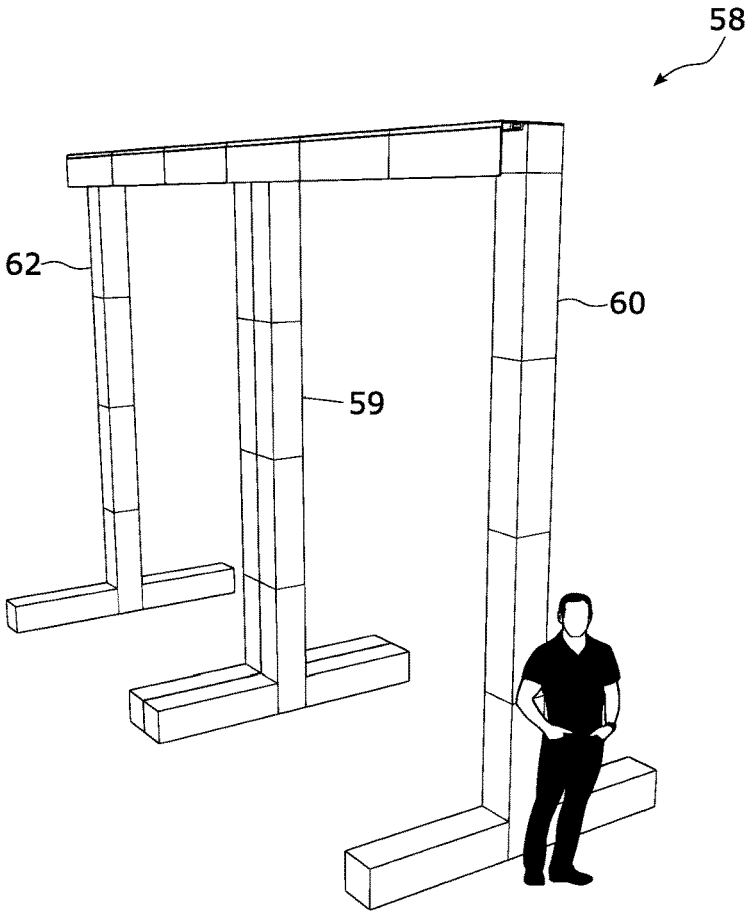
FIG. 6 shows a perspective view of another truss system.

FIG. 6 shows a perspective view of a truss system 58 having multiple rectangular frames 60, 62. The rectangular frames comprise interconnected rectangular tubes 59 (described above with reference to FIGS. 1-4). A human is depicted adjacent the truss system 58 to show a relative size of the truss system 58 (e.g. which may be large enough to be viewable to a crowd of people viewing video displays attached thereto, from a suitable distance). In this drawing, two rectangular frames 60, 62 are shown, however any number of rectangular frames could be included in the truss system 58. A rectangular frames may be positioned proximal to at least one adjacent rectangular frame. Adjacent rectangular frames may be connected, for example with fasteners including, but not limited to, bolts, nuts, and the like. In some configurations, adjacent rectangular frames may be aligned on an axis. In further configurations, a number of adjacent rectangular frames are aligned on one axis while another number of adjacent frames are aligned on a second axis; in these configurations, a curved horizontal beam for suspending video displays may connect a rectangular frame on the first axis with a rectangular frame on the second axis.

Figure 7:
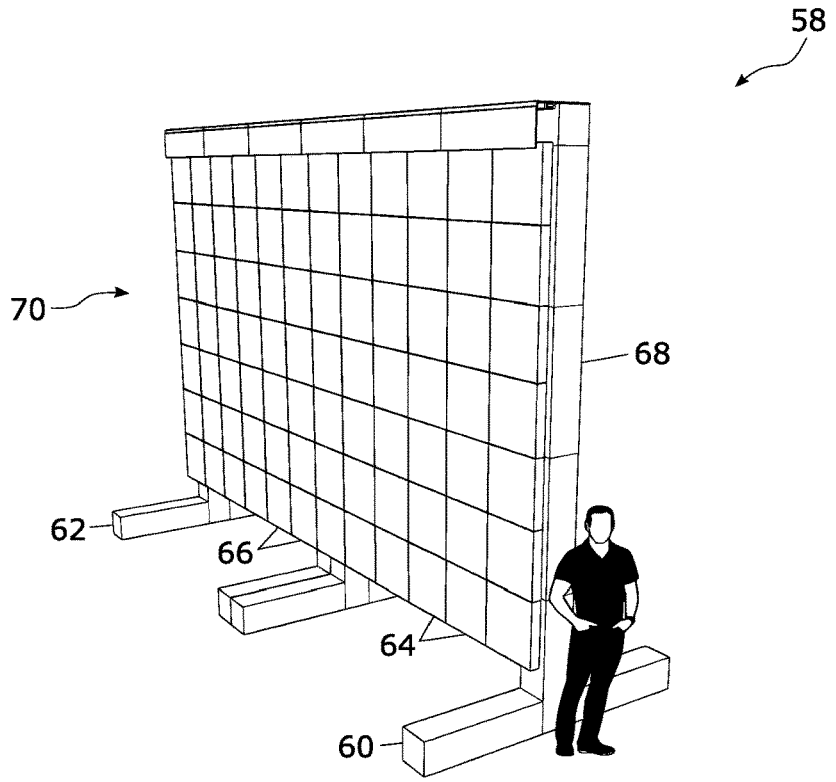
FIG. 7 shows a perspective view of the truss system with video displays.

FIG. 7 shows a perspective view of the truss system 58 from FIG. 6 with suspended video displays 64, 60. The video displays could be, but are not limited to, rear and/or forward projection units, LED units, or LCD (liquid crystal display) units. The truss system 58 may be configured such that the combined center of mass of the truss system 58 and the video displays 64, 60 is supported by the truss system 58.

In FIG. 7, forty-two video displays 64, 66 are suspended from a rectangular frame 60, 62 (e.g. eighty-four video displays in total), however, any number of video displays 64, 66 may be suspended from a rectangular frame. In some configurations, a rectangular frame 60, 62 may suspend a single video display. A video display 64, 66 may be positioned proximal and adjacent to one or more neighboring video display tiles on the same rectangular frame or an adjacent rectangular frame. A video display 64, 66 may be secured or connected to one or more neighboring video displays. Further, the video displays 64, 66 be positioned on a plane, such that the video displays 64, 60 form a continuous viewing surface.

In some configurations, including the configuration shown in FIG. 7, the combined width of the suspended video displays 64, 66 may be approximately equal to the combined width of the respective rectangular frame 60, 62 from which the video displays are suspended. In this configuration, the video displays 64, 66 may conceal at least the vertical sides 68 of the rectangular frames 60, 62 when viewed from the front side 70 (e.g. with a rigging plate 72 etc., adapted accordingly, as described hereafter). The video displays 64, 66 of adjacent rectangular frames 60, 62 may collectively have a continuous viewing surface.

Figure 8:
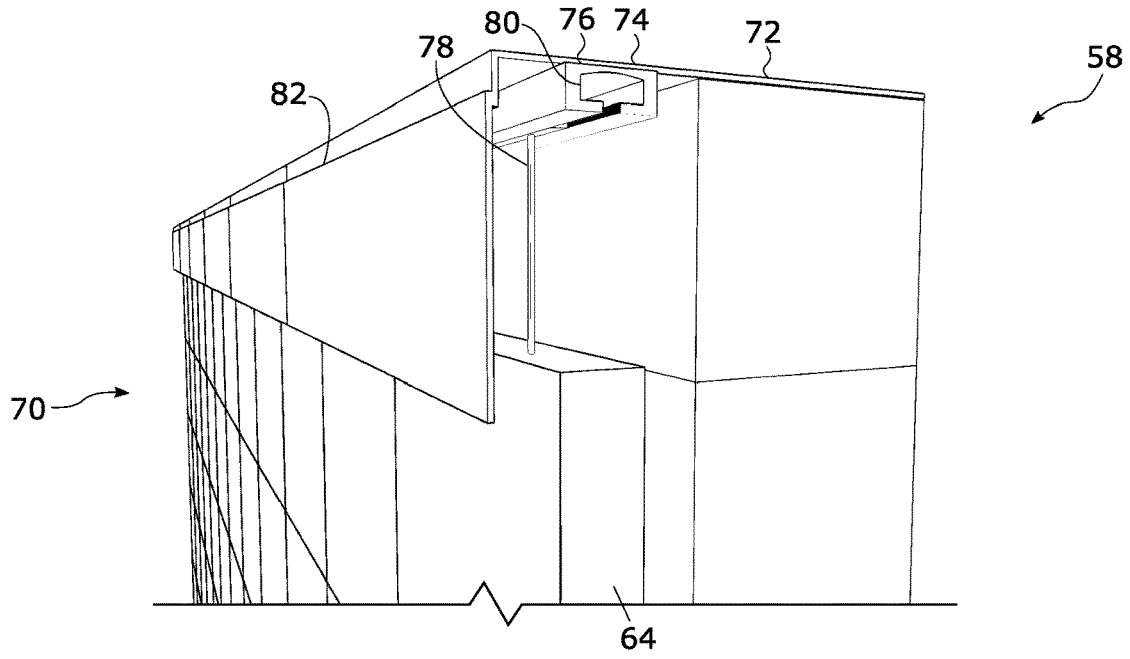
FIG. 8 shows a partial perspective view of the truss system with video displays.

Referring now to FIG. 8, a partial perspective view of the truss system 58 with suspended video displays 64 is shown. The truss system 58 includes a rigging plate 72 with a portion of the rigging plate 74 overhanging the front side 70 of the truss system 58. The rigging plate 72 may include one or more attachment apparatuses 76. In this configuration, the attachment apparatus 76 comprises a slidable attachment mechanism 76. One or more connectors 78 may be configured to suspend the video displays 64 from the slidable attachment mechanism 72. The connectors 78 may be configured to connect to one or more video displays 64. The connectors 78 may be further configured to slide along a track 80 of the slidable attachment mechanism 76. The rigging plate may further include a screen 82 positioned to hide the slidable attachment mechanism 76 and the connectors 78 from view.

The disclosed truss system provides a number of advantages including cost, speed of assembly, versatility, and safety. Because the truss system may not require ballast, the system may be assembled quickly and inexpensively. Additionally, the truss system may reduce or eliminate the need to ship ballast to the assembly site. When using the truss system without ballast, calculations may not be required to determine the appropriate amount of ballast, so there may be fewer opportunities for error. Furthermore, the truss system may be assembled in locations that lack the appropriate ceiling structure to suspend a video wall. Moreover, the truss system may be used without expensive motors to suspend the video displays.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

It is understood that for the purpose of this specification, language of "at least one of X, Y, and Z" and "one or more of X, Y and Z" can be construed as X only, Y only, Z only, or any combination of two or more items X, Y, and Z (e.g., XYZ, XY, YZ, XZ, and the like). Similar logic can be applied for two or more items in any occurrence of "at least one . . . " and "one or more . . . " language.

The terms "about", "substantially", "essentially", "approximately", and the like, are defined as being "close to", for example as understood by persons of skill in the art. In some examples, the terms are understood to be "within 10%," in other examples, "within 5%", in yet further examples, "within 1%", and in yet further examples "within 0.5%".

Persons skilled in the art will appreciate that there are yet more alternative examples and modifications possible, and that the above examples are only illustrations of one or more embodiments. The scope, therefore, is only to be limited by the claims appended hereto.

What is claimed is:

1. A truss system for video displays comprising:

a rectangular frame comprising an interconnected assembly of rectangular tubes; and a rigging plate removably attached to a top surface of the rectangular frame, the rigging plate including an overhanging portion that overhangs a front side of the rectangular frame;

the overhanging portion including a slidable attachment mechanism; and the attachment apparatus configured to suspend at least one video display from the overhanging portion such that, when the at least one video display is attached thereto, the at least one video display overhangs the front side of the rectangular frame and slides, relative to the rectangular frame, via the slidable attachment mechanism.

2. The truss system of claim 1, further comprising a plurality of support feet extending from a bottom end of the rectangular frame, the plurality of support feet forming a portion of the interconnected assembly of rectangular tubes.

3. The truss system of claim 2, wherein the plurality of support feet are configured to support the rectangular frame such that, when the at least one video display is attached to the rigging plate, the rectangular frame and the at least one video display have a combined center of mass supported by the plurality of support feet.

4. The truss system of claim 1, wherein the slidable attachment mechanism further comprises a track and at least one connector slidable in the track, the at least one connector configured to suspend the at least one video display therefrom.

5. The truss system of claim 1, wherein:

the interconnected assembly of rectangular tubes defines a cavity therein, the interconnected assembly of rectangular tubes comprising openings for accessing the cavity.

6. The truss system of claim 5, wherein the rigging plate further comprises respective openings positioned to substantially align with the openings of the interconnected assembly of rectangular tubes, such that the cavity is accessible via the respective openings of the rigging plate.

7. A truss system of claim 1, further comprising:

a plurality of rectangular frames, including the rectangular frame, the plurality of rectangular frames comprising a respective interconnected assembly of respective rectangular tubes, the plurality of rectangular frames positioned proximal to at least one adjacent rectangular frame; and a plurality of rigging plates, including the rigging plate, removably attached to respective top surfaces of the plurality of rectangular frames, the plurality of rigging plates including respective overhanging portions that overhang respective front sides of the plurality of rectangular frames;

the respective overhanging portions including a plurality of respective slidable attachment mechanisms configured to suspend a plurality of video displays, including the at least video display, therefrom such that, when the plurality of video displays is attached thereto, the plurality of video displays overhang respective front sides of the plurality of rectangular frames, forming a continuous viewing surface, the plurality of video displays slidable, relative to the plurality of rectangular frames, via the plurality of slidable attachment mechanisms.

8. The truss system of claim 7, wherein the plurality of rectangular frames are attached to adjacent rectangular frames.

9. The truss system of claim 7, further comprising a plurality of support feet extending from a bottom end of the plurality of rectangular frames, the plurality of support feet forming a portion of the respective interconnected assemblies of rectangular tubes.

10. The truss system of claim 9, wherein the plurality of support feet are configured to support the plurality of respective rectangular frames such that, when the plurality of video displays are attached to the plurality of respective rigging plates, the respective rectangular frames and the plurality of respective video displays have a respective combined center of mass supported by the plurality of respective support feet.

11. The truss system of claim 7, wherein the slidable attachment mechanisms further comprise a track and at least one connector slidable in the track, the at least one connector configured to suspend the at least one video display therefrom.

12. The truss system of claim 7, wherein:

the interconnected assemblies of rectangular tubes define a cavity therein, the interconnected assembly of rectangular tubes comprising openings for accessing the respective cavity.

13. A truss system of claim 12, wherein the rigging plates further comprise openings positioned to substantially align with the openings of the respective interconnected assemblies of rectangular tubes, such that the cavity is accessible via the respective opening of the rigging plate.

* * * * *